US006443389B1

(12) United States Patent
Palone

(10) Patent No.: US 6,443,389 B1
(45) Date of Patent: Sep. 3, 2002

(54) SELF THREADING AIR BAR

(75) Inventor: Thomas W. Palone, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/692,403

(22) Filed: Oct. 19, 2000

(51) Int. Cl.[7] ..... B65H 23/32; B65H 20/00

(52) U.S. Cl. ..... 242/615.12; 226/95; 226/97.3; 242/615.3

(58) Field of Search ..... 226/97.3, 95; 242/615.12, 242/615.3, 615.1

(56) References Cited

U.S. PATENT DOCUMENTS 2,908,495 A * 10/1959 Andrews et al. ..... 226/95
3,186,326 A 6/1965 Schmidt
4,474,320 A 10/1984 Rueger
4,525,757 A * 6/1985 Imanishi et al. ..... 242/615.12
4,842,177 A * 6/1989 Callender et al. ..... 242/615.12
4,889,269 A 12/1989 Long et al.
4,892,243 A * 1/1990 Long et al. ..... 242/615.12
5,209,387 A 5/1993 Long et al.
5,224,641 A 7/1993 Spicer
6,004,432 A * 12/1999 Page et al. ..... 226/97.3

* cited by examiner

*Primary Examiner*—Michael R. Mansen
(74) *Attorney, Agent, or Firm*—Mark G. Bocchetti

(57) ABSTRACT

An air-bearing apparatus for aiding in conveying a web is taught comprising a central web support housing including a cylindrical surface and two sides. There is an end cap positioned adjacent each of the two sides, the end caps and the central web support housing defining at least one plenum therein. The central web support housing is provided with a plurality of bores extending from the at least one plenum to the cylindrical surface, the plurality of bores forming at least one row of air jet orifices in the cylindrical surface wherein each bore is directed approximately parallel to a cylindrical axis of the central web support housing with adjacent bores being oppositely directed, the at least one row of air jet orifices extending around at least a portion of the circumference of the cylindrical surface over which the web travels. The air jets are preferably equally spaced around that portion of the circumference of the cylindrical surface that the web travels (the working circumference) and alternate to the left and right exiting the cylindrical surface at the web centerline.

11 Claims, 2 Drawing Sheets

SELF THREADING AIR BAR

FIELD OF THE INVENTION

This invention relates generally to apparatus for conveying and guiding webs, and more particularly, to fluidic bearings or air bars for conveying and guiding moving webs.

BACKGROUND OF THE INVENTION

A variety of air-bearing apparatus for web conveyancing are generally well known in the art. U.S. Pat. No. 3,186,326 to Schmidt, U.S. Pat. No. 4,889,269 to Long et al., and U.S. Pat. No. 5,224,641 to Spicer teach exemplary air-bearing apparatus. The apparatus described in these patents support the web or media with a plurality of various holes or slot patterns. Through these orifices, pressurized fluid escapes under the web with sufficient normal force to float the web being conveyed. In addition, prior art devices have provided orifice configurations designed to provide various lateral center-guiding features, that is, for maintaining a moving web approximately centered on the air bar. The air bar apparatus described in the prior art tends to have problems when the web tension is removed, such as when web movement is stopped. When this occurs, the web is typically blown off the apparatus unless it is contained with another device. This may require re-threading of the web through or across the air-bar and other apparatus through which the web is being conveyed. This, in turn, results in lost operational time and increased material waste.

SUMMARY OF THE INVENTION

It is therefore an object of the present invention to provide an air-bearing apparatus for supporting the web in a non-contacting fashion.

It is a further object of the present invention to provide an air-bearing apparatus that controls web position radially relative to the air-bearing apparatus when the web is not under tension.

Briefly stated, the foregoing and numerous other features, objects and advantages of the present invention will become readily apparent to those skilled in the art upon a review of the specification, claims and drawings set forth herein. These features, objects and advantages are accomplished by providing preferably a single row of generally axially directed air jets around the centerline of the cylindrical surface of an air bar wherein adjacent jets are opposingly directed. The air jets exit the surface with an included angle of 25° or less to the surface and should be approximately parallel with the axis of the cylindrical surface. The terms "generally axially" and "approximately parallel with the axis" as used herein are intended to mean that there is an axially directed component to the flow of air exiting the air jets, and that axially directed component is directed parallel to the axis of the air bar, or within an angle of plus or minus about 25° of being parallel to the axis of the air bar. The air jets are preferably equally spaced around that portion of the circumference of the cylindrical surface that the web travels (the working circumference) and alternate to the left and right exiting the cylindrical surface at the web centerline.

Alternatively, two partial circumferential rows of axially directed air jets can be used. A first row of air jets would be generally directed toward one side of the air bar and a second row of air jets generally directed toward the opposite side of the air bar. The two rows of orifices should be staggered relative to one another. Additionally, it is believed that three or more rows of axially directed air jets can be used. For example, a first row could be positioned at the centerline with the second and third rows offset therefrom, one on each side of the center row. All three rows would be staggered from one another so that no two air jets are axially aligned with one another. It should be understood that the offset or spacing between rows of air jets may be very small such that two or more rows may simulate a single row.

A low pressure zone is created around each air jet by the high velocity air exiting the orifice. It is this low pressure which provides a vacuum interface that keeps the web from blowing off of the air bar while still supporting the web in a non-contacting manner of the cylindrical surface of the air bar. In other words, this interface between the web and the air jets holds the web down proximate to the cylindrical surface yet maintains approximately a 0.010" air film between the web and the cylindrical surface. An additional feature of the present invention is its ability to self-thread or wrap the web such that, when combined with existing linear air tracks, the present invention can provide an entire self-threading web path. An exemplary air track or gas film conveyor for elongated strips of web material is taught in U.S. Pat. No. 5,209,387 to Long et al.

The air bar of the present invention has a self-wrapping feature. If the leading edge of the web is advanced to intercept the surface of the air bar tangentially, as the web is advanced further, the web is deflected (wrapped) around the air bar exiting where the apertures end.

DETAILED DESCRIPTION OF THE INVENTION

Figure 1:
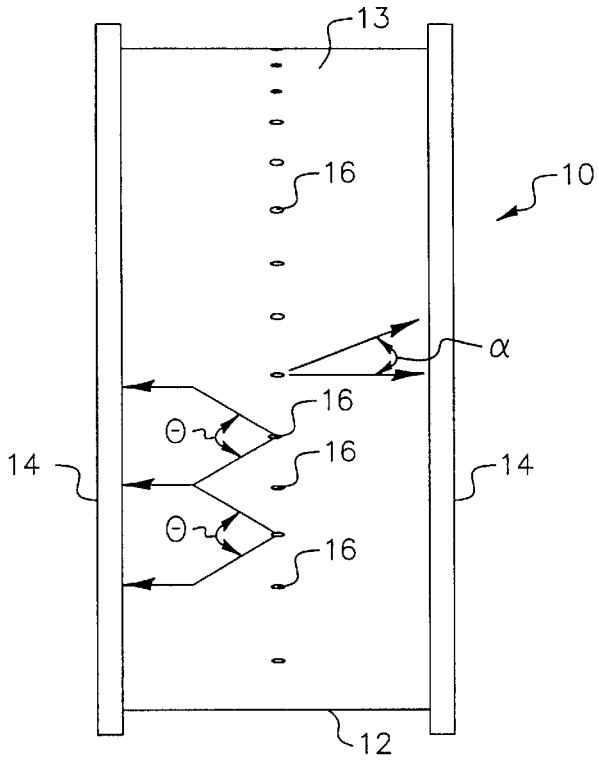
FIG. 1 is a front elevational view of the air bearing center guiding apparatus of the present invention.
Figure 2:
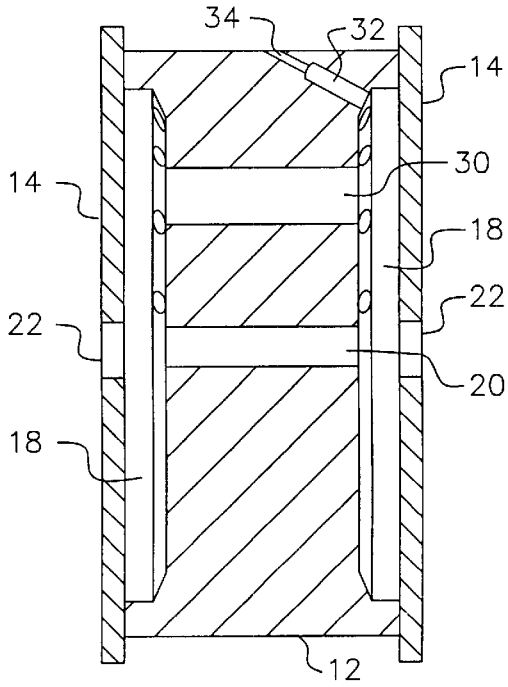
FIG. 2 is a cross-sectional view of the air bearing center guiding apparatus of the present invention.
Figure 3:
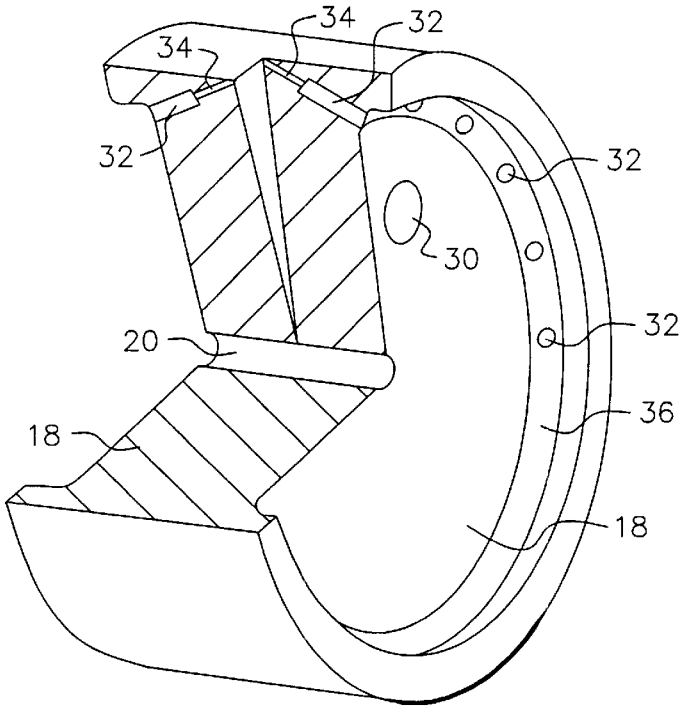
FIG. 3 is a partially sectioned perspective view of the central web support housing.
Figure 4:
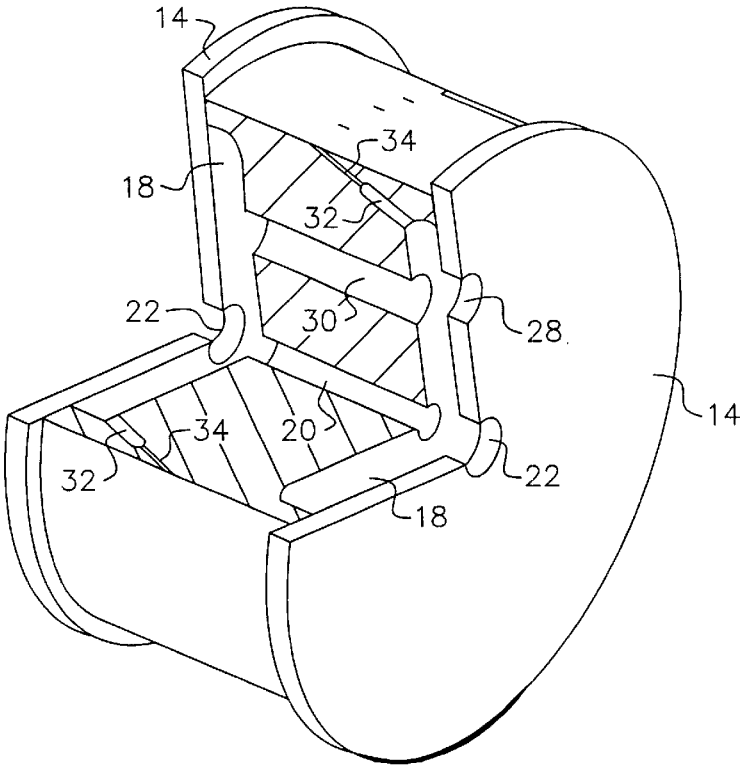
FIG. 4 is a partially sectioned perspective view of the air bearing center guiding apparatus of the present invention.

Turning first to FIG. 1 there is shown a front elevation of the air bearing center guiding apparatus 10 of the present invention. The air bearing apparatus 10 includes a central web support housing 12 and a pair of end caps 14. The central web support housing 12 includes a cylindrical surface 13 having at least one row of air jet orifices 16 therein. The central web support housing 12 is preferably cylindrical and has an axial counter-bore or chamber 18 in each end thereof (See FIGS. 2 and 3). Chambers 18 in combination with end caps 14 form a pair of air plenums. There is a center bore 20 through central web support housing 12. There are aligning bores 22 in each end cap 14 allowing a machine bolt and nut (not shown) to retain end caps 14 on central web support housing 12. At least one of the end caps 14 includes an air inlet orifice 28 (see FIG. 4) through which air at pressure greater than atmospheric pressure can be delivered to the apparatus. There is preferably a second bore 30 through central web support housing 12 which serves to connect chambers 18. In this manner, a single conduit can supply air to both chambers 18 which, in combination with second bore 30, actually form what may be considered a single plenum.

The air jet orifices 16 are machined into at least that portion of the circumference of the central web support housing 12 about which a traveling web is to be wrapped.

The air jet orifices 16 extend from the perimeter of each chamber 18 to the surface of central web support housing 12. The air jet orifices 16 exit the surface with an included angle of 25° or less to the surface of the central web support housing 12 and should reside in the plane containing the axis of the cylindrical surface. Adjacent air jet orifices 16 originate from opposite chambers 18. In this manner, air flow from a single air jet orifice 16 is generally opposite to the direction of air flow from the air jet orifice 16 on either side thereof.

Each air jet orifice 16 is preferably drilled in two stages with a larger diameter primary bore 32 and a smaller diameter air delivery bore 34. This arrangement allows for easier fabrication of central web support housing with the air jet orifices 16. The larger diameter primary bores 32 can be drilled and tapped allowing for the precise drilling of the smaller diameter air delivery bores 34. In addition, each chamber 18 may be machined to include a chamfered (or more accurately described as conical) surface 36 design to be generally perpendicular to the angle of air jet orifices 16.

In operation, the chambers 18 supply the back side of the plurality of air jet orifice 16 with pressurized air or another fluid delivered thereto through a conduit (not shown) connected to air inlet orifice 28. The two end caps 14, in addition to forming part of the plenums discussed above also serve as soft non-contacting edge guides for the web. This is the result of the air stream exiting the air jet orifices 16 hitting the end caps 14 and being redirected generally radially outwardly providing a "soft" non-contact lateral edge guide. If and when the lateral forces acting on the web exceed the pneumatic edge guiding capabilities, the end caps 14 act as physical non-rotating edge guides. However, in a web path consisting of all air conveyance components, these lateral forces rarely exceed the pneumatic edge guiding capability of the apparatus 10 of the present invention.

By way of example, the width of the central web support housing 12 should be manufactured to a dimension of about 0.020" over the maximum slit width of the media or web to be transported, resulting in the proper clearance between the end caps for the soft edge guiding capabilities. As a specific example, an air bar of the present invention has been successfully used with 35 mm(1.378 in) film. The film was 0.007 inches thick. The web support housing 12 was 1.398 inches wide. Each air jet orifice 16 had a diameter of 0.0225 inches. The single row of air jet orifices 16 was located at substantially the centerline of the web support housing 12. Each air jet 16 was directed substantially axially and at an angle of 25 degrees to the surface. This exemplary air bar with nineteen orifices 16 was supplied with a 10 psi regulated air supply.

Those skilled in the art will recognize that the alternating air jet orifices 16 may be angled slightly such that the air jet orifices 16 do not reside in but instead intercept a plane containing the axis of the central web support housing 12. For example, the air jet orifices 16 may be directed at an angle of 5° in the direction of travel of the web to thereby provide a motivating force to the media or web being transported. This arrangement could be used to maintain a small tension in the media when the machines drives are disabled and aid in automated thread-up of the machine in combination with the self-wrapping property. However, the air jet orifices 16 should not be directed at too great an angle because this would result in air flow pushing the web away from the cylindrical surface of the central web support housing 12. For example, on a 3 inch diameter air bar, this forward propulsion angle $\alpha$ (see FIG. 1) would be limited to approximately 25 degrees due to the relative fall off of the local surface area surrounding the apertures exit. For angles above this departure angle the negative pressure below the web is dramatically reduced due to the increasing relative volume and reduced fluid velocity. Thus this limiting angle, while always acute, will also vary with the air bar diameter, the larger the diameter, the greater this angle can deviate from the cylinders axis. It is important to understand that the degree of the forward propulsion angle is limited by the diminishing Bernoulli effect.

The air stream exiting each air jet orifice 16 diverges to an included angle $\theta$ of approximately 25 degrees (see FIG. 1) under the web being conveyed. The two adjacent air streams from every other aperture combine in a laminar fashion without dramatically reducing the air streams velocity as the pie-shaped 25 degree air stream path diverges as shown in FIG. 1. As the frequency of the apertures increases, the two adjacent air streams exiting from two similarly directed orifices 16 can combine in a turbulent fashion, resulting in an unstable condition. For the example given above, with a 3" diameter air bar the air jet orifices 16 should preferably be equally spaced at 10° around the circumference of the cylindrical surface of the central web support housing 12 and alternate to the left and right exiting the cylindrical surface at the web centerline. Air jet orifice spacing will vary with the diameter of a particular air bar. The 10° spacing of the air jet orifices 16 will decrease as the air bar diameter increases.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

Parts List

10 air bearing center guiding apparatus
12 central web support housing
13 cylindrical surface
14 end caps
16 air jet orifices
18 an axial counter-bore or chamber
20 center bore
22 aligning bores
28 air inlet orifice
30 second bore
32 larger diameter primary bore
34 smaller diameter air delivery bore
36 chamfered surface

What is claimed is:

1. An air-bearing apparatus for aiding in conveying a web comprising:

(a) a central web support housing including a cylindrical surface and two sides;

(b) an end cap positioned adjacent each of the two sides, the end caps and the central web support housing defining at least one plenum therein; and (c) a plurality of bores extending from the at least one plenum to the cylindrical surface, the plurality of bores forming at least one row of air jet orifices in the cylindrical surface wherein each bore is directed approximately parallel to a cylindrical axis of the central web support housing with adjacent bores being oppositely directed, the at least one row of air jet orifices extending around at least a portion of the circumference of the cylindrical surface over which the web travels, the air jet orifices configured to emit a plurality of jets of air that create a low pressure zone between the web and the cylindrical surface.

2. An air-bearing apparatus as recited in claim 1 further comprising:

an orifice through at least one of the end caps through which air at above atmospheric pressure is supplied into the at least one plenum.

3. An air-bearing apparatus as recited in claim 1 wherein:

there are two plenums, one adjacent each of the end caps.

4. An air-bearing apparatus as recited in claim 3 further comprising:

a bore through the central web support housing connecting the two plenums.

5. An air-bearing apparatus as recited in claim 3 wherein:

the two plenums are axial counter-bores machined into the two sides of the central web support housing.

6. An air-bearing apparatus as recited in claim 5 further comprising:

a chamfered surface in each of the counter-bores through which the plurality of bores is drilled.

7. An air-bearing apparatus as recited in claim 1 wherein:

the air jet orifices exit the cylindrical surface with an included angle of not more than 25° from the cylindrical surface of the central web support housing in a plane containing the axis of the central web support housing.

8. An air-bearing apparatus as recited in claim 1 wherein:

the air jet orifices are directed at an acute angle in a direction of travel of the web with respect to a line traversing the cylindrical surface perpendicular to the direction of travel of the web to thereby provide a motivating force to the web while maintaining a Bernoulli effect on the web and the cylindrical surface.

9. An air-bearing apparatus as recited in claim 1 wherein:

the end caps extend radially beyond the central web support housing to provide physical edge guides for the web.

10. An air-bearing apparatus as recited in claim 9 further comprising:

soft non-contacting edge guides for the web generated by air from the air jet orifices flowing from beneath the web between the end caps and a respective edge of the web the air being redirected generally radially.

11. An air-bearing apparatus as recited in claim 10 wherein:

the soft non-contacting edge guides are air streams exiting the air jet orifices, hitting the end caps and being redirected generally radially outwardly thereby.

* * * * *